United States Patent [19]

Tong

[11] Patent Number: 4,885,501

[45] Date of Patent: Dec. 5, 1989

[54] BLACKENING OF NON IRON-BASED FLAT TENSIONED FOIL SHADOW MASKS

[75] Inventor: Hua Sou Tong, Mundelein, Ill.

[73] Assignee: Zenith Electronics Corporation, Glenview, Ill.

[21] Appl. No.: 174,660

[22] Filed: Mar. 29, 1988

Related U.S. Application Data

[63] Continuation-in-part of Ser. No. 127,724, Nov. 30, 1987, abandoned.

[51] Int. Cl.[4] ..... H01J 29/07

[52] U.S. Cl. ..... 313/402; 313/408

[58] Field of Search ..... 313/402, 403, 408

[56] References Cited

U.S. PATENT DOCUMENTS

| | | | |
|---|---|---|---|
| 4,210,843 | 7/1980 | Avandani | 313/403 |
| 4,664,996 | 5/1987 | Moscony et al. | 313/402 X |
| 4,734,615 | 3/1988 | Koike et al. | 313/402 |

FOREIGN PATENT DOCUMENTS

| | | |
|---|---|---|
| 121628 | 10/1984 | European Pat. Off. . |
| 175370 | 3/1986 | European Pat. Off. . |
| 2217280 | 10/1973 | Fed. Rep. of Germany . |
| 2183903 | 6/1987 | United Kingdom . |

*Primary Examiner*—Kenneth Wieder

[57] ABSTRACT

The power handling capacity of non iron-based flat tensioned foil shadow masks for flat faceplate cathode ray tubes (CRTs) is enhanced by providing the flat tensioned mask (FTM) with a thin outer layer of iron, which is converted to iron oxide by blackening, or heating. The iron layer, which is preferably at least 0.04 mil thick, is deposited on the FTM by electroplating in a ferrous ammonium sulfate bath either before or after chemical etching of the FTM. The thin iron layer increases FTM emissivity and reduces FTM doming at high electron beam energies. The iron coating may be blackened in the frit-like cycle during CRT assembly or in a separate heating operation. A blackened outer layer of cobalt may also be used to increase FTM emissivity.

13 Claims, 4 Drawing Sheets

BLACKENING OF NON IRON-BASED FLAT TENSIONED FOIL SHADOW MASKS

CROSS-REFERENCE TO RELATED APPLICATIONS AND PATENTS

This application is a continuation-in-part of application Ser. No. 127,724, filed on Nov. 30, 1987, now abandoned, by Michael Livshultz and Hua-Sou Tong for "Improved Material, and Assemblies For Tensioned Foil Shadow Masks", and assigned to the assignee of the present application.

This application is related to but in no way dependent upon co-pending applications Ser. No. 051,896, filed May 18, 1987; Ser. No. 060,142, filed June 9, 1987; Ser. No. 832,556, filed Feb. 21, 1986, now U.S. Pat. No. 4,695,761; Ser. No. 835,845, filed Mar. 3, 1986; Ser. No. 843,890, filed Mar. 25, 1986; Ser. No. 866,030, filed Apr. 21, 1986; Ser. No. 875,123, filed June 17, 1986; Ser. No. 881,169, filed July 2, 1986; Ser. No. 948,212, filed Dec. 31, 1986; Ser. No. (5424), filed Nov. 11, 1987; and U.S. Pat. Nos. 4,210,843; 4,593,224; 4,591,344; 4,593,225; 4,595,857; 4,614,892; 4,652,791; 4,656,388; 4,672,260 and 4,678 447, all of common ownership herewith.

BACKGROUND OF THE INVENTION

This invention relates generally to flat faceplate cathode ray tubes, and more particularly to tubes of this type which have a tensioned foil shadow mask. The invention also relates to a process for the manufacture of such tubes, including depositing an iron or cobalt layer on the tensioned foil shadow mask followed by blackening the metallic coating to provide improved shadow mask emissivity for accommodating high electron beam energies Also disclosed is a cathode ray tube front assembly containing such a mask.

Cathode ray tubes having flat faceplates and correspondingly flat tensioned foil shadow masks are known to provide many advantages over conventional cathode ray tubes having a curved faceplate and a curved shadow mask. A chief advantage of a flat faceplate cathode ray tube with a tensioned mask is a greater electron beam power-handling capability, a capability which can provide greater picture brightness. The power-handling capability of tubes having the conventional curved mask is limited due to the thickness of the mask (5 to 7 mils), and the fact that it is not mounted under tension. As a result, the mask tends to expand or "dome" in picture areas of high brightness where the intensity of electron beam bombardment, and consequently the heat, is greatest. Color impurities result when the mask expands toward the faceplate and the beam-passing apertures in the mask move out of registration with their associated phosphor dots or lines on the faceplate.

A tensioned foil mask when heated acts in a manner quite different from a curved, untensioned mask. For example, if the entire mask is heated uniformly, the mask expands and relaxes the tension. The mask remains planar and there is no doming and no distortion until the mask has expanded to the point that tension is completely lost. Just before all tension is lost, wrinkling may occur in the corners. When small areas of a tensioned foil mask are differentially heated, the heated areas expand and the unheated areas correspondingly contract, resulting in only small displacements within the plane of the mask. However, the mask remains planar and properly spaced from the faceplate and, consequently, any color impurities are unnoticeable.

The mask must be supported in tension in order to maintain the mask in a planar state during operation of the cathode ray tube. The amount of tension required will depend upon how much the mask material expands upon heating during operation of the cathode ray tube Materials with very low thermal coefficients of expansion need only a low tension. Generally, however, the tension should be as high as possible because the higher the tension, the greater the heat incurred, and the greater the electron beam current that can be handled. There is a limit to mask tension, however, as too great a tension can cause the mask to tear.

The foil mask may be tensioned in accordance with known practices. A convenient method is to thermally expand the mask by means of heated platens applied to both sides of the foil mask. The expanded mask is then clamped in a fixture and, upon cooling, remains under tension. The mask may also be expanded by exposure to infrared radiation, by electrical resistance heating, or by stretching through the application of mechanical forces to its edges.

PRIOR ART

It is well known in the manufacture of standard color cathode ray tubes of the curved-mask, curved-screen type to heat-treat the shadow masks prior to their being formed into a domed shape. Conventional (non-tensioned) shadow masks are typically delivered to cathode ray tube manufacturers in a work-hardened state due to the multiple rolling operations which are performed on the steel to reduce it to the specified thickness, typically about 6 mils. In order that the masks may be stamped into a domed shape, they must be softened by use of an annealing heat treatment—typically to temperatures on the order of 700°-800°C. Annealing also enhances the magnetic coercivity of the masks, a desirable property from the standpoint of magnetic shielding of the electron beams. After stamping, and the consequent moderate work hardening of the mask which may result from the stamping operation, it is known in the prior art to again anneal the masks while in their domed shape to further enhance their magnetic shielding properties.

Foils intended for use as tensioned masks are also delivered in a hardened state—in fact, much harder than standard masks in order to provide the very high tensile strength needed to sustain the necessary high tension levels; for example, 30,000 psi, or greater. The prior art annealing process, with its relatively high annealing temperatures, would be absolutely unacceptable if applied to flat tension masks, as any extensive softening or reduction of tensile strength of the mask resulting from the process would make the material unsuited for use as a tension mask.

The disclosure of U.S. Pat. No. 4,210,843 to Avedani, of common ownership herewith, sets forth an improved method of making a conventional color cathode ray tube shadow mask; that is, a curved shadow mask having a thickness of about 6 mils, and designed for use with a correlatively curved faceplate. The method comprises providing a plurality of shadow mask blanks composed of an interstitial-free steel, each with a pattern of apertures photo-etched therein, which blanks have been cut from a foil of steel, precision cold-rolled to a full hard condition, and with a thickness of from 6 to 8 mils. A stack of blanks is subjected to a limited annealing operation carried out at a relatively low maximum temperature, and for a relatively brief period sufficient only to achieve recrystallization of the material without causing significant grain growth. Each blank is clamped and drawn to form a dished shadow mask without the imposition of vibration or roller leveling operations, and thus avoids undesired creasing, roller marking, denting, tearing or work-hardening of the blank normally associated with these operations. The end-product shadow mask, due to the use of the interstitial free steel material, has an aperture pattern of improved definition as a result of more uniform stretching of the mask blank. The annealing operation has little effect on the magnetic properties of this type of steel, and the coercivity of the material, after forming, is about 2.0 oersteds.

A foil shadow mask is maintained under high tension within the cathode ray tube, and the mask is subjected to predetermined relatively high temperatures during tube manufacture. A process for pre-treating a metal foil shadow mask is disclosed in referent copending application Ser. No. 948,212, of common ownership herewith. The process comprises preheating the shadow mask in a predetermined cycle of temperature and time effective to minimize subsequent permanent dimensional changes in the mask that occur when it is subjected to the predetermined relatively high temperatures, but ineffective to significantly reduce the tensile strength of the mask by annealing.

Earlier foil mask materials have limitations in terms of the desired combination of mechanical and magnetic properties described herein. One material used in tensioned foil shadow mask applications in flat faceplate cathode ray tubes has been aluminum-killed (AK), AISI 1005 cold-rolled capped steel, generally referred to as AK steel. AK steel has a composition of 0.04 percent silicon, 0.16 percent manganese, 0.028 percent carbon, 0.020 percent phosphorus, 0.018 percent sulfur, and 0.04 percent aluminum, with the balance iron and incidental impurities. (Throughout the specification and claims, all percentages are considered weight-percentages, unless otherwise indicated.) Invar, which has a nominal composition of 36 percent nickel, balance iron, has also been suggested as a possible material for tensioned foil shadow masks. Invar however has a thermal coefficient of expansion far lower than that of the glass commonly used in cathode ray tube faceplates and so is considered generally unacceptable.

The material of the masks treated according to the Ser. No. 948,212 disclosure is the aforedescribed AK steel. AK steel, while it can be formed into a fairly acceptable foil shadow mask, is deficient in certain important properties. For example, the yield strength of AK steel foil one mil thick is typically in the range of 75–80 ksi. This makes it only marginally acceptable from a strength standpoint. More importantly, AK steel has a permeability that is much lower than desired, for example, 5,000 in a 1 mil foil. Since the ability of a material to carry magnetic flux decreases with decreasing cross-section cathode ray tubes having masks made of AK steel thinner than about 1 mil may require both internal and external magnetic shielding. With internal shielding only, the beam landing misregistration due to the earth's magnetic field, i.e., the change in beam landing position upon reversal of the axial field component, is typically 1.5 mils, which is much greater than the maximum of about 1 mil that is generally considered tolerable.

In addition, AK steel is metallurgically dirty, having inclusions, defects and dislocations which interfere with both the foil rolling process and the photo resist etching of the apertures in the foil resulting in higher scrap rates and consequently lower yields.

Another significant disadvantage of an AK steel tensioned foil shadow mask is the fact that as the tension applied is increased, the permeability decreases and the coercivity increases. Translated into picture performance, this means that as the tension of the AK foil shadow mask is increased in order to permit increased beam current and, therefore, greater picture brightness, its ability to shield the electron beams from the earth's magnetic field deteriorates, resulting in increased beam misregistration.

The present invention overcomes the aforementioned limitations of the prior art by providing a tensioned foil shadow mask having a thin outer iron layer which substantially increases the emissivity of the shadow mask and retards its rate of temperature increase in reducing shadow mask doming at high electron beam energies.

OBJECTS OF THE INVENTION

Accordingly, it is an object of the present invention to provide an improved flat tensioned foil shadow mask for use in a color cathode ray tube having a flat faceplate.

Another object of the present invention is to provide an improved process for fabricating a cathode ray tube incorporating a flat tensioned foil shadow mask.

A further object of the present invention is to provide a flat tensioned foil shadow mask having improved mechanical properties.

Yet another object of the present invention is to provide for the treatment of prior art flat tensioned foil shadow masks so as to substantially increase their thermal radiation characteristics and current handling capabilities.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), wherein like reference numerals identify like elements, and in which:

DESCRIPTION OF THE PREFERRED EMBODIMENT

To facilitate understanding of the process and material according to the invention and their relation to the manufacture of a color cathode ray tube having a tensioned foil shadow mask, a brief description of a tube of this type and its major components is offered in the following paragraphs.

Figure 1:
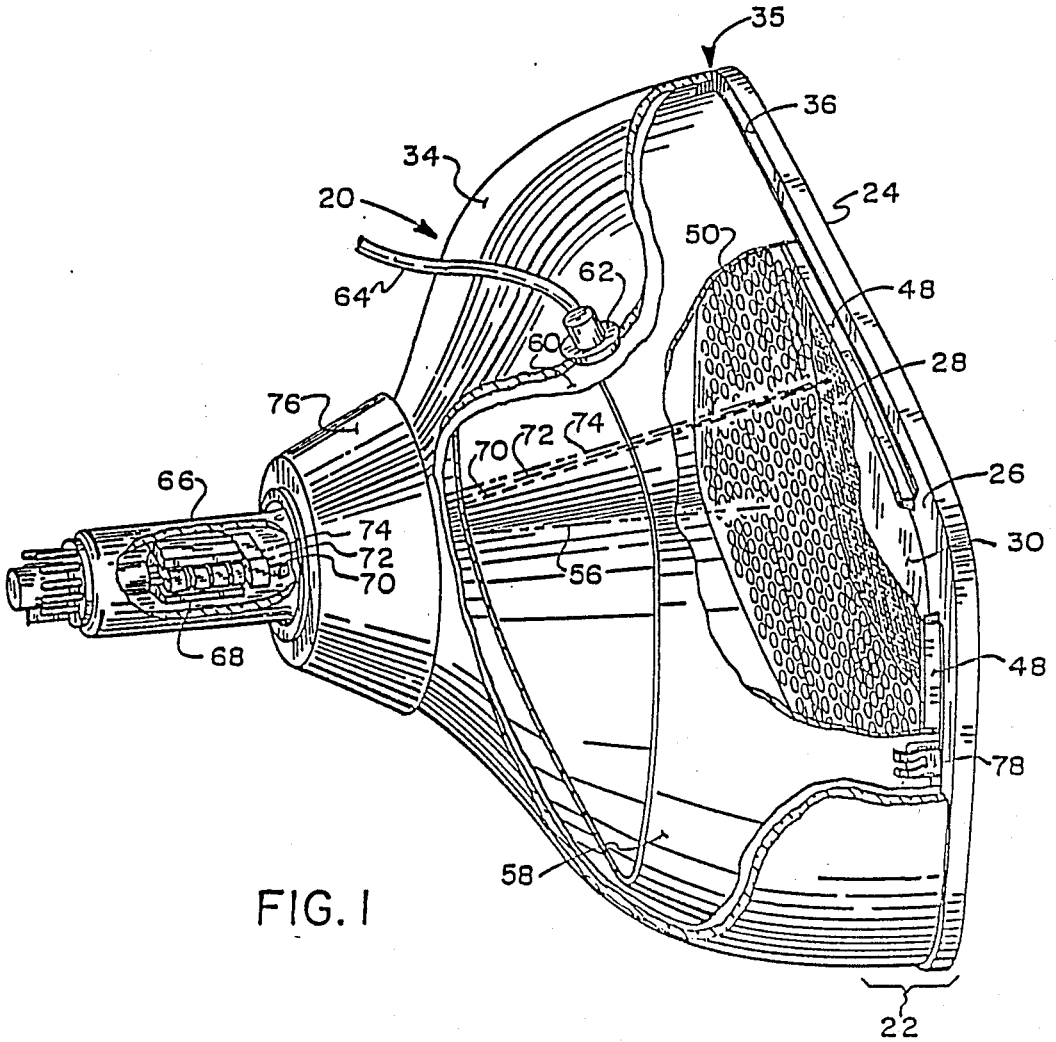
FIG. 1 is a side view in perspective of a color cathode ray tube having a flat faceplate and a tensioned foil shadow mask, with cut-away sections that indicate the location and relation of the faceplate and tensioned foil shadow mask to other major tube components.

A color cathode ray tube 20 having a tensioned foil shadow mask is depicted in FIG. 1. The faceplate assembly 22 essentially comprises a flat faceplate and a tensioned flat foil shadow mask mounted adjacent thereto. Faceplate 24, indicated as being rectangular, is shown as having on its inner surface 26 a centrally located phosphor screen 28 depicted diagrammatically as having a pattern of phosphors thereon. A film of aluminum 30 is indicated as covering the pattern of phosphors. A funnel 34 is represented as being attached to faceplate assembly 22 at their interfaces 35; the funnel sealing surface 36 of faceplate 24 is indicated as being peripheral to screen 28. A frame-like shadow mask support structure 48 is indicated as being located on opposed sides of the screen between funnel sealing surface 36 and screen 28, and mounted adjacent to faceplate 24. Support structure 48 provides a surface for receiving and mounting in tension a metal foil shadow mask 50 a Q-distance away from the screen 28. The pattern of phosphors corresponds to the pattern of apertures in mask 50. The apertures depicted are greatly exaggerated for purposes of illustration; in a high resolution color tube for example, the mask has as many as 750,000 such apertures, with aperture diameter being on the average about 5 mils. As is well-known in the art, the foil shadow mask acts as a color-selection electrode, or "parallax barrier" which ensures that each of the beamlets formed by the three beams lands only on its assigned phosphor deposits on the screen.

The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68 depicted as providing three discrete in-line electron beams 70, 72 and 74 for exciting respective red-light-emitting, green-light-emitting, and blue-light-emitting phosphor elements deposited on screen 28. Yoke 76 receives scanning signals and provides for the scanning of beams 70, 72 and 74 across screen 28. An electrical conductor 78 is located in an opening in shield 58 and is in contact with conductive coating 60 to provide a high-voltage connection between the coating 60, the screen 28, and shadow mask 50. This means of electrical conduction is described and claimed in referent copending application Ser. No. 060,142 of common ownership herewith.

Figure 2:
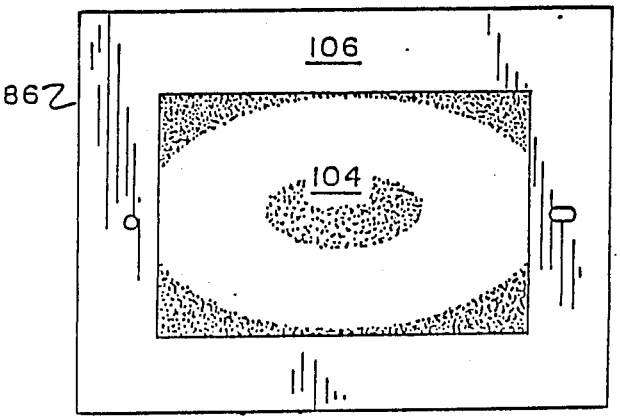
FIG. 2 is a plan view of an in-process foil shadow mask.

Two of the major components, designated as being "in-process," are depicted and described as follows. One is a shadow mask indicted diagrammatically in FIG. 2. In-process shadow mask 86 includes a central area 104 of apertures corresponding to the pattern of phosphors that is photodeposited on the screen of the faceplate by using the mask as an optical stencil. Center field 104 is indicated as being surrounded by an unperforated section 106, the periphery of which is engaged by a tensing frame during the mask tensing and clamping process, and which is removed in a later procedure.

Figure 3:
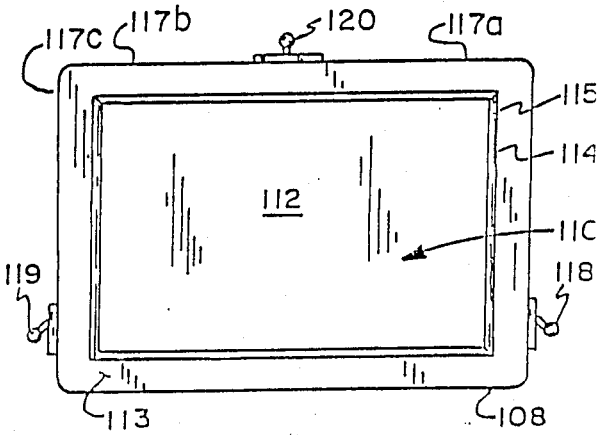
FIG. 3 is a plan view of an in-process flat glass faceplate showing a phosphor screening area and a foil shadow mask support structure secured thereto.

An in-process faceplate 108 is depicted diagrammatically in FIG. 3 as having on its inner surface 110 a centrally located screening area 112 for receiving a predetermined phosphor pattern in an ensuing operation. A funnel sealing surface 113 as indicated as being peripheral to screen 112. A frame-like shadow mask support structure 114 is depicted as being secured on opposed sides of screen 112; the structure provides a surface 115 for receiving and mounting a foil shadow mask under tension a Q-distance from the screen.

A process according to the invention essentially comprises providing an apertured foil shadow mask 86 comprised of a non iron-based alloy such as nickel-iron alloy, and securing the mask 86 to the mask support structure 114 of the faceplate 108 while under tension, and in registration with the phosphor screen. The process is further characterized by first subjecting the mask 86 to an electroplating process for coating the mask with a thin iron layer followed by blackening the iron coating such as by exposing it to high temperatures for providing the mask with favorable heat dissipating properties. The present invention also contemplates providing the mask with a cobalt rather than iron layer, although for simplicity the invention is described in the following paragraphs as making use of a layer of iron.

A class of nickel-iron alloys, desirably containing minor additions of certain alloying agents, when heat-treated and cooled under controlled conditions, yield a material which, when fabricated into a thin foil, has mechanical and magnetic properties not found in known alloys that make them uniquely suited for use as tensioned foil shadow masks.

With regard to the alloy composition, a nickel-iron alloy is provided comprising between about 30 and about 85 weight-percent of nickel, between about 0 and 5 weight-percent of molybdenum, between 0 and 2 weight-percent of one or more of vanadium, titanium, hafnium, and niobium, with the balance iron and incidental impurities; e.g., carbon, chromium, silicon, sulfur, copper and manganese. Typically, the incidental impurities combined do not exceed 1.0 percent. Alternately and also according to the invention, the alloy may comprise between about 75 and 85 weight-percent of nickel, between about 3 and 5 weight-percent of molybdenum, with the balance iron and incidental impurities. Preferably, the alloy may comprise about 80 weight-percent nickel, about 4 weight-percent molybdenum, with the balance iron and incidental impurities. These examples of foil mask materials are generally referred to as molypermalloys.

MASK HEAT TREATMENT DURING FRIT CYCLE

The heat treatment of the masks described in the following paragraphs closely approximates the processing steps in frit sealing cathode ray tube, and the sealing of the funnel and faceplate in the manufacturing process.

As indicated in FIG. 3 a shadow mask support structure 114 is secured on the inner surface 110 of faceplate 108 between the peripheral sealing area, noted as being the funnel sealing surface 113, and the screening area 112. The mask support structure 114 provides a surface 115 for receiving and supporting a foil shadow mask in tension. The mask support structure 114 may comprise, by way of example, a stainless steel metal alloy according to the disclosure of referent copending application Ser. No. 832,556, or alternately, a ceramic structure according to the disclosure of referent copending application Ser. No. 866,030. Attachment of the support structure is preferably by means of a devitrifying frit.

The alloy according to the invention is formed into a foil having a thickness of about 0.001 inch or less. A central area 112 of the foil is apertured to form a foil mask 108 consonant in dimensions with the screening area 112 for color selection. Aperturing of the mask can be accomplished by a photo-etching process in which a light-sensitive resist is applied to the foil. The resist is hardened by exposure to light except in those areas where apertures are defined. The exposed metal defining the apertures is then etched away.

The foil mask is then tensed in a tensing frame to a tension of at least about 25 Newton/centimeters. A tensing frame suitable for use in tensing a mask foil, and the process for tensing, is fully described and claimed in referent copending application Ser. No. 051,896, of common ownership herewith. In essence, the foil may be expanded by enclosing it between two platens heated to 360° C. for one minute, clamped in the tensing frame, and air cooling it to provide a tensioned foil having a greater length and width than the faceplate to which it will be secured. A pattern of red-light-emitting, green-light-emitting, and blue-light-emitting phosphor deposits are sequentially photoscreened on screening area 112. The photoscreening process includes repetitively registering the foil to the phosphor screening area by registering the tensing frame with the faceplate. The means of registration is fully set forth in the referent 896 application.

The foil comprising the mask 86 is secured to the mask support structure 114, with the apertures of the mask in registration with the pattern of phosphor deposits on screening area 112. The means for securing the mask to the mask support structure may be by welding with a laser beam, with the excess mask material removed by the same beam, as fully described and claimed in referent copending application Ser. No. 058,095, of common ownership herewith. Inasmuch as the faceplate 108 and tensioned foil shadow mask 86 are rigidly interconnected by their mutual attachment to the mask support structure, the thermal coefficient of expansion of the alloy foil must approximate that of the faceplate, which is typically a glass having a coefficient of expansion of between about $12\times10^{-6}$ and about $14\times10^{-6}$ in/in/°C. This is necessary due to the relatively high temperatures to which the faceplate and mask are subjected during the cathode ray tube manufacturing process. A coefficient of expansion somewhat greater than that of the faceplate can be tolerated, but a coefficient of expansion substantially less than that of the faceplate is to be avoided as this may lead to mask failure during the manufacturing process.

Figure 4:
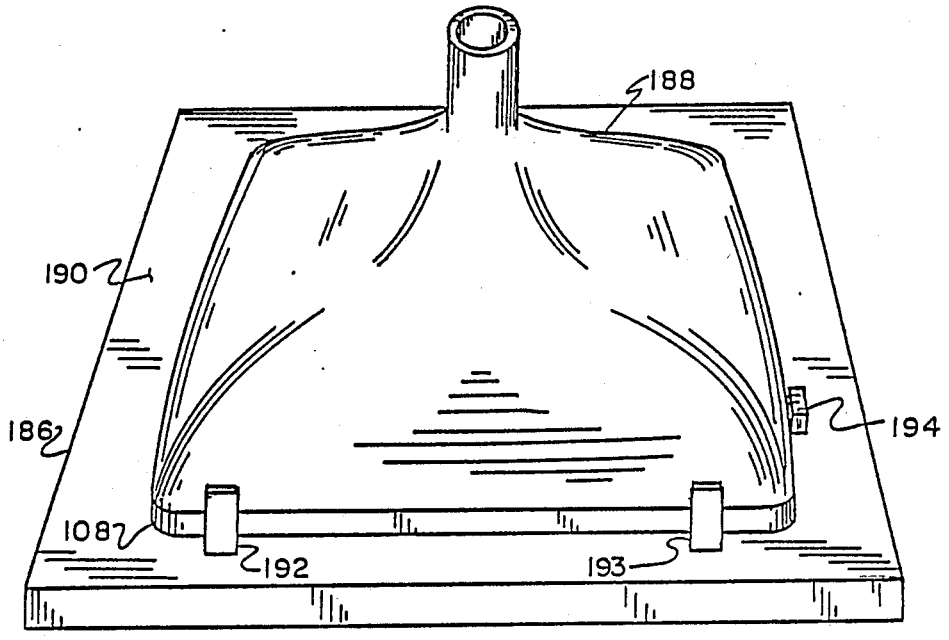
FIG. 4 is a perspective view of a funnel referencing and fritting fixture, with a funnel and the faceplate to which it is to be attached shown as being mounted on the fixture.
Figure 5:
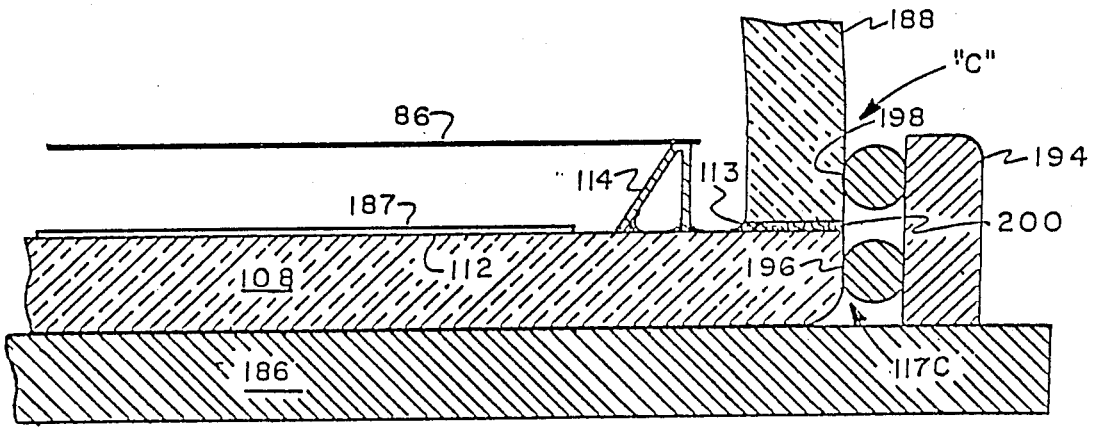
FIG. 5 is a partial detail view in section and in elevation depicting the attachment of a funnel to a faceplate.

FIGS. 4 and 5 depict the use of a funnel referencing and fritting fixture 186 for mating of a faceplate 108 with a funnel 188 to form a faceplate-funnel assembly. Faceplate 108 is indicated as being installed face down on the surface 190 of fixture 186. Funnel 188 is depicted as being positioned thereon and in contact with funnel sealing surface 113, noted as being peripheral to screening area 112 on which is deposited a pattern of phosphors 187 as a result of the preceding screening operation. With reference to FIG. 4, three posts 192, 193 and 194 are indicated as providing for alignment of the funnel and faceplate. FIG. 5 depicts details of the interface between post 194, the faceplate 108, and funnel 188. Flat 117*c* on faceplate 108 is shown as being in alignment with reference area "c" on funnel 188. Shadow mask 86, noted as being in tension, is depicted as being mounted on shadow mask support structure 114; this configuration of a shadow mask support structure is the subject of U.S. Pat. No. 4,686,416 of common ownership herewith.

Post 194 is shown as having two reference points 196 and 198 for locating the funnel 188 with reference to the faceplate 108. The reference points preferably comprise buttons of carbon as they must be immune to the effects of the elevated oven temperature incurred during the frit cycle. The use of funnel referencing and fritting fixture in the registration of a faceplate and a funnel is fully described in referent copending application Ser. No. (5452).

A devitrifiable frit in paste form is applied to the peripheral sealing area of the faceplate 108, noted as being funnel sealing area 113, for receiving funnel 188. The faceplate 108 is then mated with the funnel 188 to form a faceplate-funnel assembly. The frit, which is indicated by reference No. 200 in FIG. 5, may for example, comprise frit No. CV-130, manufactured by Owens-Illinois, Inc. of Toledo, Ohio.

The faceplate-funnel assembly is then heated to a temperature effective to devitrify the frit and permanently attach the funnel to the faceplate, after which the assembly is cooled. The process of fusing of the funnel to the faceplate is generally carried out under conditions referred to as the frit cycle. In a typical frit cycle, the faceplate, to which the tensioned foil mask is adhered, and funnel are slowly heated to 435° C., then cooled to room temperature or slightly thereabove over a period of 3–3½ hours. The foil must be cooled to the temperature at which the alloy is substantially recrystallized at a cooling rate of less than about 5° C. per minute, preferably less than about 3° C. per minute, and most desirably at a rate of between about 2° C. and about 3° C. per minute. The heating of the assembly and the foil is effective to blacken, or oxidize, a thin iron layer deposited on the foil mask in accordance with the present invention as described in detail below.

In accordance with the present invention, the non iron-based foil mask is provided with a thin iron layer which is then blackened, or oxidized, to provide the foil mask with substantially enhanced emissivity. The non iron-based foil mask used in a preferred embodiment is comprised of the above described nickel-iron alloy, although the present invention is contemplated for use with virtually any non iron-based foil mask material. The iron coating and blackening of the foil mask may be performed before or after mask etching as described above.

Figure 6:
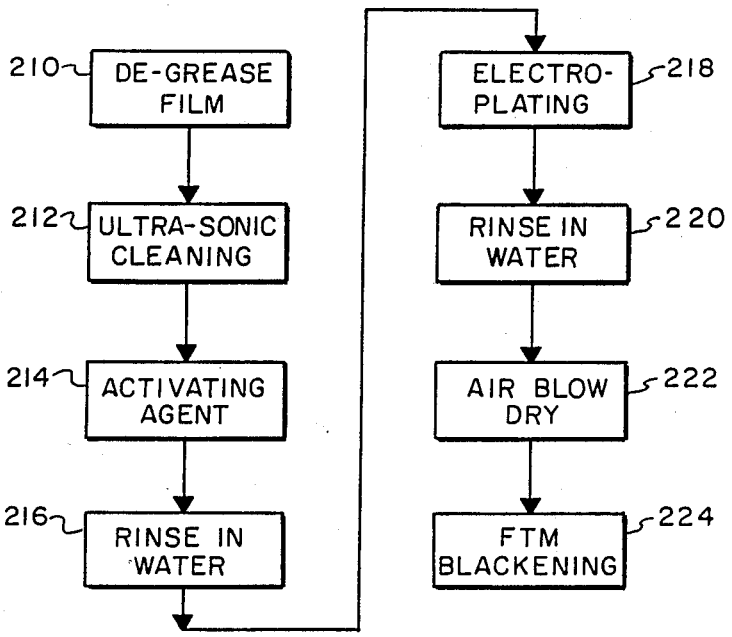
FIG. 6 is a flow chart illustrating in simplified form the steps carried out in producing a tensioned foil shadow mask in accordance with the present invention.

Referring to FIG. 6, there is shown a simplified flow chart for a procedure for treating a foil mask in accordance with the principles of the present invention. Although the procedure described in FIG. 6 discloses the use of an electroplating process in forming a thin layer of iron on the surface of the foil mask, the present invention is not limited to this method of surface coating of thin layers as other processes well known to those skilled in the art could be used equally as well. For example, the iron layer could be deposited on the foil mask by vacuum deposition or plasma spraying. The first step at block 210 in the process involves degreasing of the foil tension mask (FTM). The FTM may be degreased by dipping it into a hot alkaline solution for on the order of 10 minutes. The next step at block 212 is the ultrasonic cleaning of the degreased FTM. The degreasing and ultrasonic cleaning procedures remove contaminants from the surface of the FTM which decrease the effectiveness of the subsequent electroplating process.

At step 214, the FTM is dipped in an activating agent in order to lower the surface energy of the FTM prior to electroplating. Lowering the surface energy of the FTM facilitates the electroplating of the FTM. The activating agent is preferably 50% hydrochloric acid which is rinsed away by water at step 216. The FTM then undergoes an electroplating process at step 218 wherein a thin layer of iron at least 0.04 mil thick is deposited on its surface. After electroplating, the FTM is then cleaned in tap water at step 220 to remove any excess electroplating solution, followed by air blow drying of the iron coated FTM at step 222. Finally, the iron surface of the FTM is blackened to provide the foil mask with a substantially increased emissivity which increases its power handling capacity by reducing the doming tendency of the FTM at large electron beam currents.

Figure 7:
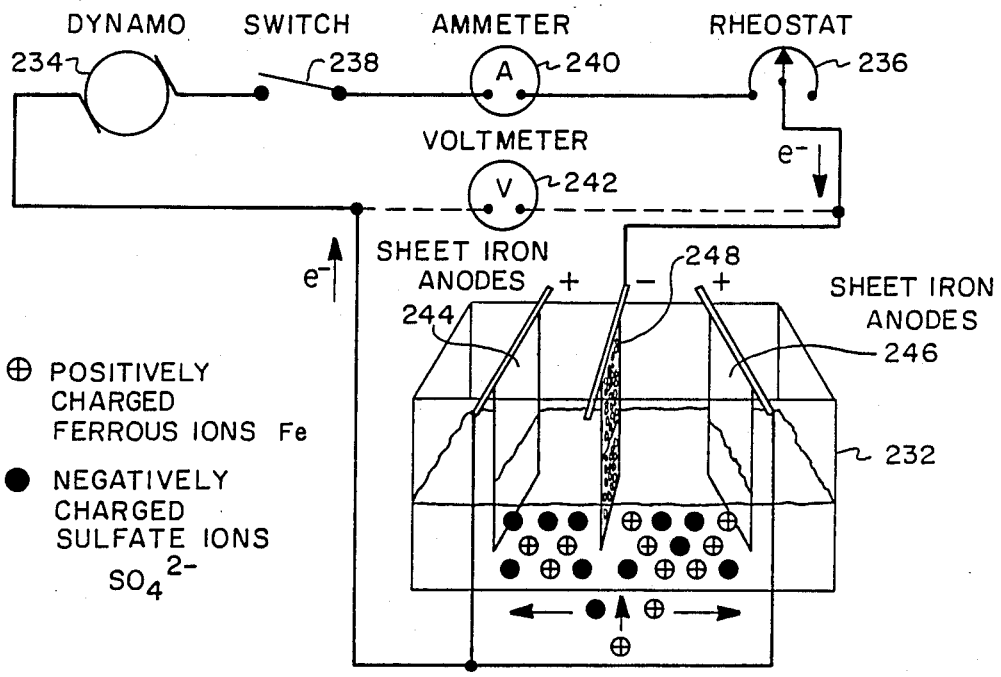
FIG. 7 is a simplified schematic diagram of an electroplating arrangement for depositing an iron layer on a tensioned foil shadow mask in accordance with the present invention.

Referring to FIG. 7, there is shown a simplified schematic diagram of an electroplating arrangement 230 for use in treating a foil mask in accordance with the principles of the present invention. While a batch-type of electroplating arrangement is illustrated in FIG. 7 and described in the following paragraphs, the present invention also contemplates the use of a continuous electroplating process using techniques well known to those skilled in the relevant art. In a continuous electroplating process, a long continuous strip of foil mask material would typically be unwound from a roller, passed through an electroplating bath, and wound onto a take-up roller. The batch electroplating arrangement 230 includes a plating tank 232 containing an electrolyte solution comprised of ferrous sulfate and ammonium sulfate. The ammonium sulfate assists in stabilizing the acidity of the electrolyte solution, which is preferably maintained within the range of 4.5– 5.5. If the pH drops below 3.5, ferric hydroxide ($Fe(OH)_3$) forms as a water insoluble precipitate, while if the pH increases above 6.0, ferrous hydroxide ($Fe(OH)_2$) forms as a water insoluble precipitate. The presence of either of the aforementioned insoluble precipitates decreases the efficiency of the electroplating process.

A dynamo 234 supplies electric current which is controlled by a rheostat 236. When the switch 238 is closed, the cathode bar, which holds the foil mask 248 to be plated, is charged negatively. Some of the electrons from the cathode bar transfer to the positively charged iron ions ($Fe_{+2}$), setting them free as atoms of iron metal. These iron atoms take their place on the cathodic foil mask 248, iron plating it.

Simultaneously, the same number of sulfate ions ($SO_4^{-2}$) are discharged on the sheet iron anodes 244 and 246, thereby completing the electrical circuit. In so doing, the sulfate ions form a new quantity of ferrous sulfate that dissolves in the electrolyte solution and restores it to its original composition. The current deposits a given amount of iron on the cathode and the anode dissolves at the same rate, maintaining the solution more or less uniformly. An ammeter 240 and voltmeter 242 permit the current and voltage across the electrodes within the electroplating tank 232 to be carefully monitored for controlling the electroplating process. Materials which have been successfully used as the anodes in the electroplating process have included stainless steel, aluminum killed (AK) steel, and cold rolled steel.

It has been found that exposing a molypermalloy foil mask to the above described electroplating process for 5 minutes in a ferrous ammonium sulfate bath produces a thin coating layer of iron 0.04 mil in thickness on each side of the mask. The present invention is contemplated for use in a continuous foil electroplating arrangement wherein a continuous roll of foil mask material is passed through the electroplating bath to provide it with a thin iron outer layer on both sides thereof. The foil mask material may then be subjected to the photo resist and chemical etching procedures described above to provide the foil mask material with an array of apertures therein. The foil mask material may then be cut up into sections appropriately sized for use in color cathode ray tubes.

After the iron layer is deposited on the foil mask material, the foil mask is then blackened by heating it to an appropriate temperature for a predetermined duration. In one example of the present invention, the foil mask is heated to a temperature of 435° C. for 55 minutes resulting in the blackening of the outer iron layer and its conversion to iron oxide. The iron oxide layer formed on the foil mask is comprised primarily of meghemite ($\gamma$-$Fe_2O_3$) and magnetite ($Fe_3O_4$), and to a lesser extent hematite ($\alpha$-$Fe_2O_3$). This iron oxide layer substantially increases the heat dissipating capability of the foil mask and retards the rate of temperature increase of the mask upon bombardment by electron beams by efficiently and effectively radiating away heat buildup so as to minimize its thermal distortion. Blackening of the foil mask may be accomplished either before or after the foil mask is secured to the faceplate of a cathode ray tube. In the latter case, foil mask blackening and oxidizing of its outer iron layer may be accomplished during a conventional frit-lehr cycle as described above. In blackening the foil mask during the frit-lehr cycle, the assembled faceplate and funnel together with the foil mask was positioned on a belt moving at a speed of 9 inches per minute and was passed through an open furnace and exposed to a peak temperature of 435° C. for 55 minutes. Subjecting the iron coated foil mask to temperatures in the range 400° C. to 600° C. for a period ranging from ½ hour to 1 hour has also resulted in blackening of the foil mask and a substantial increase in its emissivity.

Referring to Table I, there is shown the results of emissivity measurements of iron-electroplated molypermalloy foil masks. The upper row of data is for the electroplating of a foil mask in a ferrous ammonium sulfate electrolyte having a pH in the range of 4.5 to 5.5 and temperature of 35–40° C. and power of 6.4 amps/$ft^2$. The intermediate set of data is for electroplating a foil mask in a ferrous chloride and calcium chloride electrolyte solution having a pH of from 0.8 to 1.5 at a temperature of 85°–90° C. and power of 40.7 amps/ft$^2$. Various plating times in minutes are indicated in the table for both sets of data. The emittance data was taken at 40° C. using a typical IR spectrometer, while the data in the two right hand columns was obtained using an IRCON 4000 pyrometer. Measurements were made in the infrared spectrum at various wavelengths as indicated in the table.

TABLE I

EMISSIVITY MEASUREMENTS OF IRON-ELECTROPLATED MOLY-PERMALLOY

| | | EMITTANCE (at 40° C.) | | | PYROMETER (IRCON 4000) | |
|---|---|---|---|---|---|---|
| PLATING SOLUTION | PLATING TIME (min) | 5 m | 8 m | 14 m | 8 m | 8–14 m |
| Ferrous Sulfate | 1 minute | 0.88 | 0.91 | 0.59 | 0.65 | 0.68 |
| & Arroning Sulfate | | 0.64 | 0.84 | 0.45 | 0.79 | 0.65 |
| | | 0.93 | 0.60 | 0.28 | N/A | 0.60 |
| pH = 4.5–5.5 | | | | | | |
| | 2 minutes | 0.75 | 0.60 | 0.18 | N/A | >>0.60 |
| Temp. = 35–40 C. | | | | | | |
| | 5 minutes | 0.96 | 0.87 | 0.35 | N/A | 0.66 |
| Power = 6.4 A/ft**2 | (0.03 mil or | 0.93 | 0.92 | 0.51 | N/A | 0.62 |
| | 0.0008 cc) | 0.94 | 0.93 | 0.79 | N/A | 0.68 |
| | | 0.79 | 0.65 | 0.52 | 0.85 | 0.82 |
| | 10 minutes | 0.85 | 0.87 | 0.56 | 0.85 | 0.80 |
| | 15 minutes | 0.87 | 0.83 | 0.62 | 0.80 | 0.80 |
| Ferrous Chloride | 5 minutes | 0.93 | 0.89 | 0.00 | N/A | N/A |
| & Calcium Chloride | | 0.91 | 0.93 | 0.00 | N/A | N/A |
| pH = 0.8–1.5 | 10 minutes | 0.96 | 0.93 | 0.48 | N/A | N/A |
| | | 0.97 | 0.85 | 0.23 | N/A | N/A |
| Temp = 85–90 C. | | | | | | |
| Power = 40.7 A/ft**2 | | | | | | |
| | 15 minutes | 0.98 | 0.90 | 0.30 | N/A | N/A |
| | | 0.98 | 0.90 | 0.29 | N/A | N/A |
| | | 0.98 | 0.94 | 0.28 | N/A | N/A |
| | | 0.98 | 0.94 | 0.28 | N/A | N/A |
| AE Mask Frit Seal | | 0.86 | 0.77 | 0.73 | N/A | N/A |
| | | 0.81 | 0.70 | 0.63 | N/A | N/A |
| | | 0.78 | 0.69 | 0.59 | 0.65 | 0.68 |
| | | 0.75 | 0.65 | 0.52 | 0.68 | 0.70 |
| | | 0.89 | 0.74 | 0.72 | N/A | 0.68 |
| | | 0.86 | 0.81 | 0.70 | N/A | 0.68 |

For the uppermost set of data, there is a high degree of correlation in the data measured by the two different instruments. The lower row of data represents measured thermal emissivity for uncoated AK steel shadow masks after blackening. From the measured data it can be seen that the emissivity of the iron-electroplated molypermalloy masks closely approximates the thermal emissivity of prior art AK steel masks.

Figure 8:
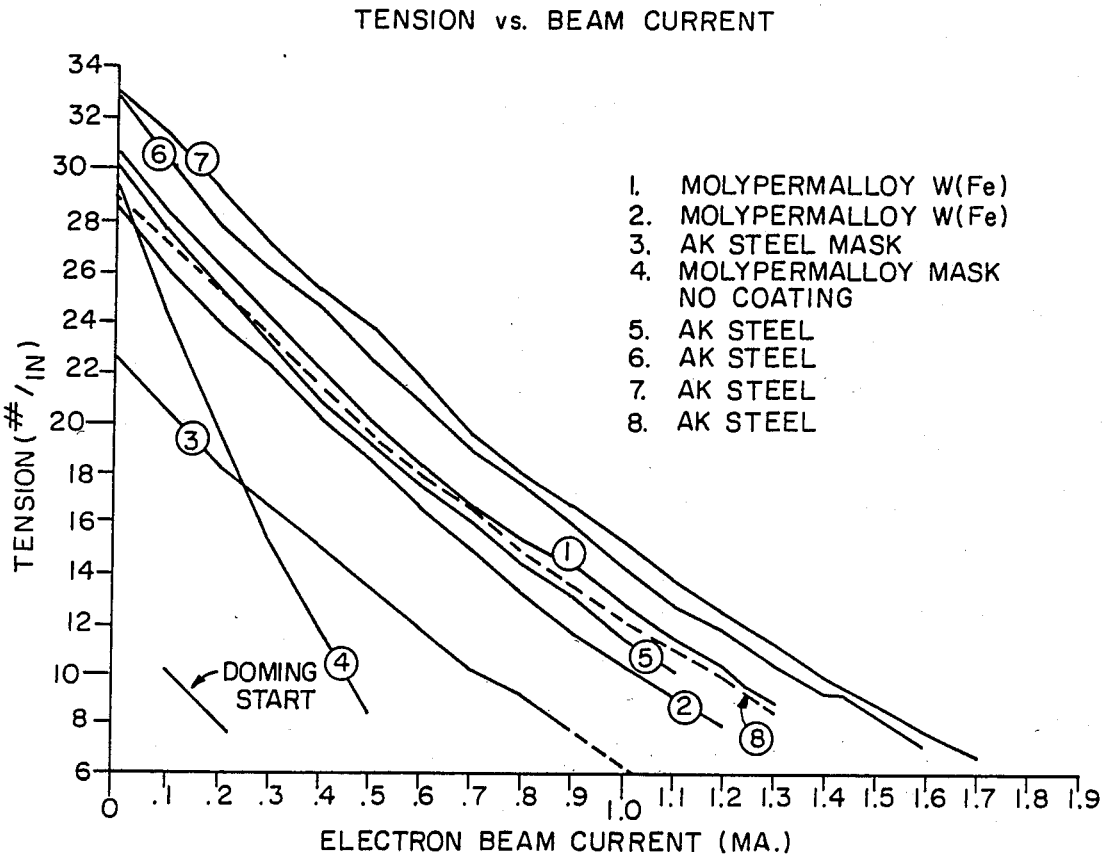
FIG. 8 presents a series of curves illustrating the change in tension of a tensioned foil shadow mask with variation in electron beam current in a cathode ray tube for various shadow mask materials including shadow masks fabricated in accordance with the present invention.

Referring to FIG. 8, there are shown various graphs illustrating the variation of foil mask tension with changes in electron beam current for foil masks of different composition. Curves 1 and 2 show the variation of mask tension with changes in electron beam current for molypermalloy foil masks coated with a blackened iron outer layer in accordance with the principles of the present invention. Curves 3, 5, 6, 7 and 8 illustrate the variation of foil mask tension with variations in electron beam current for aluminum killed (AK) steel foil masks having essentially the same composition. Curve 4 illustrates mask tension vs. electron beam current for a molypermalloy foil mask which has not been coated with a blackened iron surface in accordance with the present invention. The data presented by the graphs in FIG. 8 show that the slope of mask tension vs. electron beam current for the unplated, or uncoated, molypermalloy foil mask is substantially steeper than the slope of standard AK steel foil masks. This indicates that the unplated molypermalloy foil mask will exhibit doming at lower electron beam currents than the conventional AK steel masks. As shown by curves 1 and 2, coating the molypermalloy foil masks with an iron layer which is then blackened, or oxidized, substantially reduces the slope of the mask tension vs. beam current function. In fact, the electron beam intensity performance of the coated molypermalloy foil masks is essentially the same as that of the AK steel foil masks. From the test data illustrated in FIG. 8, it can be seen that the iron plated molypermalloy foil masks exhibit much improved performance over unplated molypermalloy foil masks at high electron beam currents, and that the high temperature performance of these plated molypermalloy foil masks closely approximates and even surpasses the operating characteristics of conventional AK steel foil masks.

Additional details of carrying out the iron electroplating of a flat tensioned foil shadow mask are as follows. The electrolyte is preferably comprised of a solution of ferrous sulfate (250 g/l) and ammonium sulfate (120 g/l), with a pH in the range of 4.0–5.5. The cathode current density used in one embodiment is 2 A/dm$^2$ (0.13 A/in$^2$ or 18.72 A/ft$^2$) or 25.5 A/mask (assuming 14"×14" exposure). The electroplating is preferably performed at a temperature of 60° C., or in the range of 30°–60° C. A solution of sulfuric acid and ammonium hydroxide can be used to control the pH. The higher pH-sulfate has better covering power for the flat tensioned foil shadow mask and yields deposits with less residual stress. Excess acid may be added to the electrolyte in order to prevent oxidation. The anode should be removed from the electrolyte bath when not in use and floating cubes of gum rubber should be allowed to float on the surface of the electrolyte bath when not in use. The aforementioned steps reduce the undesirable air oxidation of Fe(II) to Fe(III) when the electrolyte bath is not in use. The electrolyte bath may be refreshed by adding degreased iron turnings or steel wool to the bath, together with sufficient acid to lower the pH to approximately 0.5. The time required to refresh the electrolyte bath is in the range of 24–48 hours. Completion of electrolyte bath refreshing is indicated by a clear green color (free from any yellow tint) of the electrolyte solution.

Electroplating of the tensioned foil shadow mask may also be accomplished in a ferrous chloride/calcium chloride electrolyte solution which contains 300 g/l of ferrous chloride and 335 g/l of calcium chloride, with a pH in the range of 0.9–1.5. Iron electroplating in this electrolyte bath is performed with a cathode current density of 6.5 A/dm$^2$ (0.41 A/in$^2$ or 59 A/ft$^2$) or 80.4 A/mask (assuming 14"×14" exposure) at an operating temperature of 90° C. The electrolyte bath should be maintained at a relatively low temperature on the order of 25° C. to produce a hard, highly stressed layer of iron having a dark color on the flat tensioned foil shadow mask. Using a higher temperature will result in a softer, less stressed layer of iron having a lighter color deposited on the flat tensioned foil shadow mask. A finer grain size of the deposited iron layer may be achieved by adding a low concentration of $MnCl_2$.

Operational evaluations of flat tensioned foil shadow masks having a coating of a thin layer of iron (0.04 mil) have indicated that a maximum power handling capability of 2.0 mA is achievable, with a range of power handling capability of 1.3–2.0 mA versus 1.3–1.8 mA of flat faceplate CRTs having noncoated AK masks. Masks with a thicker iron coating (0.05 mil) have demonstrated an even higher power handling capability (2.7 mA). For flat faceplate CRTs having iron coated flat tensioned foil shadow masks in accordance with the present invention, a maximum N-S swing of 0.86 mil was obtained as opposed to a swing of 1.5 mil for CRTs having a noncoated flat tensioned foil shadow mask. Finally, in flat faceplate CRTs with a coated flat tensioned foil shadow mask, a maximum beam landing misregistration of 1.07 mil was obtained, while a maximum beam landing misregistration of 1.44 mil was observed in CRTs having a noncoated AK steel flat tensioned foil shadow mask.

There has thus been shown a non iron-based flat tensioned foil shadow mask for use in a color cathode ray tube having a blackened, or oxidized, outer iron (or cobalt) layer preferably at least 0.04 mil thick which substantially increases the emissivity of the shadow mask and, by retarding its rate of temperature increase and reducing shadow mask doming, permits the shadow mask to operate at high electron beam energies. More energetic electrons allow for increased brightness of the video image visible on the faceplate of the cathode ray tube. The thin iron layer is deposited on the flat tensioned foil shadow mask by electroplating the foil in a bath of ferrous and ammonium sulfate using a procedure readily adapted for large scale, commercial fabrication of cathode ray tubes with flat tensioned foil shadow masks. The thin iron layer is then blackened, or oxidized, either during frit sealing of the cathode ray tube or by subjecting the shadow mask to high temperatures in a separate step.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art. is intended to be defined in the following claims when viewed in their proper perspective based on the prior art.

I claim:

1. For use in a color cathode ray tube having a flat faceplate, a shallow mask comprising:

a non iron-based apertured foil; and a think oxidized layer of metal disposed on said foil to increase its emissivity.

2. The shadow mask of claim 1 wherein said non iron-based apertured foil is comprised of molypermalloy.

3. The shadow mask of claim 2 wherein said molypermalloy is comprised of between about 75 and 85 weight-percent nickel, between about 3 and 5 weight-percent molybdenum, with the balance iron and incidental impurities.

4. The shadow mask of claim 1 wherein said non iron-based apertured foil is comprised of between about 30 and about 85 weight-percent nickel, between about 0 and 5 weight-percent molybdenum, between 0 and 2 weight-percent of one or more of vanadium, titanium, hafnium and niobium, with the balance iron and incidental impurities.

5. The shadow mask of claim 1 wherein said oxidized layer of metal is at least 0.04 mil thick.

6. The shadow mask of claim 1 wherein said thin oxidized layer of metal is iron oxide.

7. The shadow mask of claim 6 wherein said thin iron oxide layer is comprised primarily of meghemite and magnetite, and to a lesser extent hematite.

8. The shadow mask of claim 1 wherein said thin oxidized layer of metal is cobalt oxide.

9. A shadow mask arrangement for use in a color cathode ray tube having a flat faceplate, said shadow mask arrangement comprising:

a thin non iron-based foil having an apertured center portion and a solid peripheral portion;

tension means for engaging the peripheral portion of said foil and maintaining said foil in a stretched condition, under tension; and a thin oxidized layer of metal disposed on said foil to increase its emissivity.

10. The shadow mask arrangement of claim 9 wherein said foil is comprised of molypermalloy.

11. The shadow mask arrangement of claim 9 wherein said thin oxidized layer is iron oxide.

12. The shadow mask arrangement of claim 9 wherein said thin oxidized layer is cobalt oxide.

13. An improved non iron-based foil shadow mask for use in a color cathode ray tube of the type having a plurality of apertures and which is maintained in a flat, stretched condition under tenion, wherein the improvement comprises:

a thin metal oxide layer disposed on said foil shadow mask to increase its emissivity.

* * * * *